US005664977A

United States Patent [19]

Dinkowitz et al.

[11] Patent Number: 5,664,977

[45] Date of Patent: Sep. 9, 1997

[54] BOAT PROPELLER SLED

[76] Inventors: Paul J. Dinkowitz; Janice M. O'Byrn, both of 1311 Turnbull St., New Smyrna Beach, Fla. 32168

[21] Appl. No.: 642,559

[22] Filed: May 3, 1996

[51] Int. Cl.[6] ..... B63H 5/125

[52] U.S. Cl. ..... 440/65; 440/71

[58] Field of Search ..... 440/71, 72, 65

[56] References Cited

U.S. PATENT DOCUMENTS

| | | | |
|---|---|---|---|
| D. 322,256 | 12/1991 | Reeves . | |
| 983,587 | 2/1911 | Watkins | 440/72 |
| 1,825,547 | 9/1931 | Rockwell | 440/71 |
| 3,859,953 | 1/1975 | Todt | 440/72 |
| 4,078,516 | 3/1978 | Balius . | |
| 4,565,533 | 1/1986 | Springer . | |
| 4,902,255 | 2/1990 | Faunda | 440/71 |
| 4,957,459 | 9/1990 | Snyder . | |
| 5,066,254 | 11/1991 | Bass et al. . | |
| 5,176,550 | 1/1993 | Hooper . | |
| 5,178,565 | 1/1993 | Jacobson | 440/71 |
| 5,205,766 | 4/1993 | Arsenault . | |

FOREIGN PATENT DOCUMENTS

| | | | |
|---|---|---|---|
| 1257812 | 7/1989 | Canada | 440/71 |

*Primary Examiner*—Stephen Avila
*Attorney, Agent, or Firm*—Paul S. Rooy

[57] ABSTRACT

A boat propeller sled comprising a spine, straps attached to the spine, and rails attached to the spine. The straps are sized to fit around an outboard motor lower unit, and to securely attach the spine to the lower unit. Each rail comprises a base attached to the spine, a forward ramp attached to the base, a runner attached to the forward ramp, and a rear ramp attached to the runner. In the preferred embodiment, the bases are attached to the spine at an angle of approximately ninety degrees, the forward ramps slope forward at an angle of approximately sixty degrees relative to the horizon, the runners are substantially horizontal, and the rear ramps slope upwards towards the rear at an angle of approximately thirty degrees relative to the horizon.

15 Claims, 3 Drawing Sheets

FIG 2
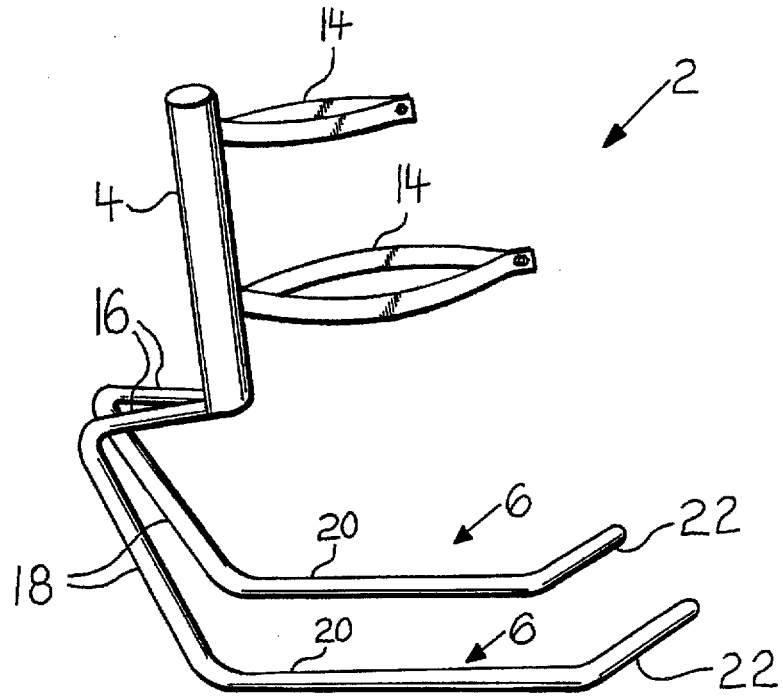
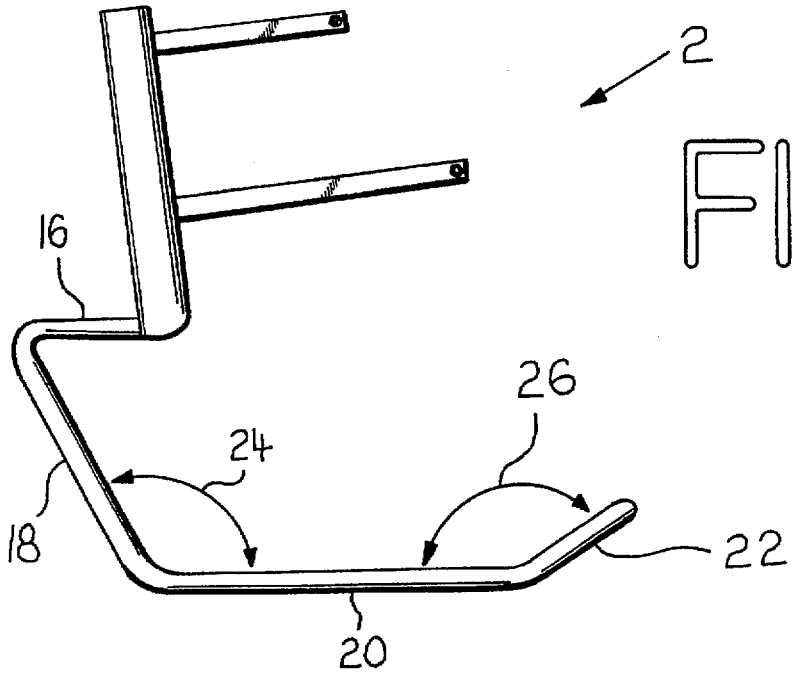
FIG 3

BOAT PROPELLER SLED

BACKGROUND OF THE INVENTION

1. Field of the Invention

This invention relates to boat propeller guards, and in particular to a boat propeller sled.

2. Background of the Invention

For some lime now, small boats have been powered by outboard motors. These small boats may include fishing boats, water ski boats, tour boats, and pleasure craft of all types. These outboard motor-powered boats generally range in size up to approximately twenty-five feet in length.

Outboard motor-equipped boats may be operated in fairly shallow water. One ever-present danger associated with operating boats in shallow water is the possibility of running the boat aground. This may occur where an un-anticipated sandbar is encountered, or perhaps an oyster bed. This can be hazardous to the boat occupants, or cause other problems, in a number of ways.

One danger is the boat occupants may be thrown overboard due to the sudden stop resulting from a boat abruptly running into a sand bar or oyster bed. Another problem may be damage to the outboard motor propeller: if the propeller strikes an oyster bed its rotation may be forced to stop against the urgings of the outboard motor, resulting in a damaged shear pin. If a shear pin is damaged, and no spare is available, then it may be impossible to change the propeller immediately.

If the boat has to be temporarily abandoned while a new shear pin is procured, a real danger exists that the boat could be stolen.

Another problem associated with current outboard motor design is that the propeller is sharp, and may rotate extremely quickly. Needless to say, this rapidly-spinning sharp propeller can present quite a hazard to swimmers and sea creatures in the vicinity of the propeller. Every year there are incidents of swimmers cut by outboard motor propellers, sometimes severely. And every year hundreds of underwater animals are injured, sometimes fatally, by outboard motor propellers. This problem is especially important where the injured animals are members of an endangered species such as manatees.

Still another problem which exists where a boat powered by an outboard motor runs aground, is that the boat may become seriously stuck on the underwater obstruction upon which it ran aground. Under these conditions, it may be impossible to free the boat short of procuring a tow from another power boat, or waiting for the tide to rise (if the boat has run aground near water under oceanic tidal influence). While modem outboard motor designs incorporate lower units which are generally curved at their lower forward edge, these lower units generally terminate in a sharp point at their lower rear corner. When an attempt to back a boat in too-shallow water is made, this sharp point tends to dig into the bottom, thus immobilizing the boat

Existing Design

One solution to these outboard motor problems has been to enclose the propeller (and in some cases the entire lower unit) in a wire cage. For example, U.S. Pat. Nos. 4,078,516, 4,957,459 and Des. 322,256 were granted to Balius, Snyder, and Reeves respectively. While these designs protected the propeller from foreign object damage, the extensive caging disrupted the water flow to the propeller, and thus reduced its efficiency.

Other designs making less extensive use of caging wire were taught in U.S. Pat. Nos. 5,176,550 and 4,565,533, granted to Hooper and Springer, respectively. While these designs appeared to impose less efficiency loss on the propeller, they terminated in a rear downwards slope. Such a rear downwards slope at the bottom of these propeller protectors caused the same digging-in problem while attempting to back a boat in too-shallow water described above. The result would be the same: to immobilize the boat.

SUMMARY OF THE INVENTION

Accordingly, it is an object of the present invention to provide a boat propeller sled which provides a wanting to a boat operator when shallow water is approaching. Design features allowing this object to be accomplished include forward-facing rail bases, and forward ramps. Advantages associated with the accomplishment of this object include the ability to reduce speed when approaching shallow water, and consequently the possibility of avoiding propeller damage and/or getting stuck.

It is another object of the present invention to provide a boat propeller sled which is capable of protecting a propeller around which it is mounted. Design features allowing this object to be accomplished include forward ramps, runners, and rear ramps. A benefit associated with the accomplishment of this object is reduced propeller damage.

It is another object of this invention to provide a boat propeller sled which allows a boat upon which it is mounted to back off an underwater obstruction without digging in the rear of the propeller sled. Design features enabling the accomplishment of this object include rear ramps is attached to framers at a rear ramp angle of approximately one hundred fifty degrees. An advantage associated with the realization of this object is speedier and easier egress off an underwater obstruction.

It is still another object of this invention to provide a boat propeller sled which protects underwater creatures and swimmers from contact with a propeller. Design features allowing this object to be achieved include rail bases, forward ramps, runners, and rear ramps attached to an outboard motor lower unit. Benefits associated with reaching this objective include reduced human and animal casualties.

It is a further object of this invention to provide a boat propeller sled which cushions the shock imparted a boat which runs aground at speed. Features permitting this object to be accomplished include forward ramps attached to bases and runners, which are attached to an outboard motor lower unit; the bases, runners and forward ramps being fabricated of semi-springy material. Benefits associated with the achievement of this object include reduced possibility of boat and motor damage, and increased boat passenger comfort.

It is another object of this invention to provide a boat propeller sled which imposes minimum water resistance and minimal propeller efficiency reduction. Features permitting this object to be accomplished include the use of a minimum number of rails (two, in the preferred embodiment). Benefits associated with the achievement of this object include maximized boat performance and fuel efficiency.

It is a further object of this invention to provide a boat propeller sled which has the capability of sliding up and over underwater obstructions, thus providing an inverse "cow-catcher" effect. Features permitting this object to be accomplished include forward ramps attached to runners at a forward ramp angle of approximately one hundred twenty degrees. Benefits associated with the achievement of this object include gentler and more gradual contact between a boat and underwater obstructions.

BRIEF DESCRIPTION OF THE DRAWINGS

The invention, together with the other objects, features, aspects and advantages thereof wilt be more clearly understood from the following in conjunction with the accompanying drawings.

Three sheets of drawings are provided. Sheet one contains FIG. 1. Sheet two contains FIGS. 2 and 3. Sheet three contains FIGS. 4 and 5.

FIG. 2 is a side isometric view of a boat propeller sled.

FIG. 3 is a side view of a boat propeller sled.

DETAILED DESCRIPTION OF THE PREFERRED EMBODIMENT

Figure 1:
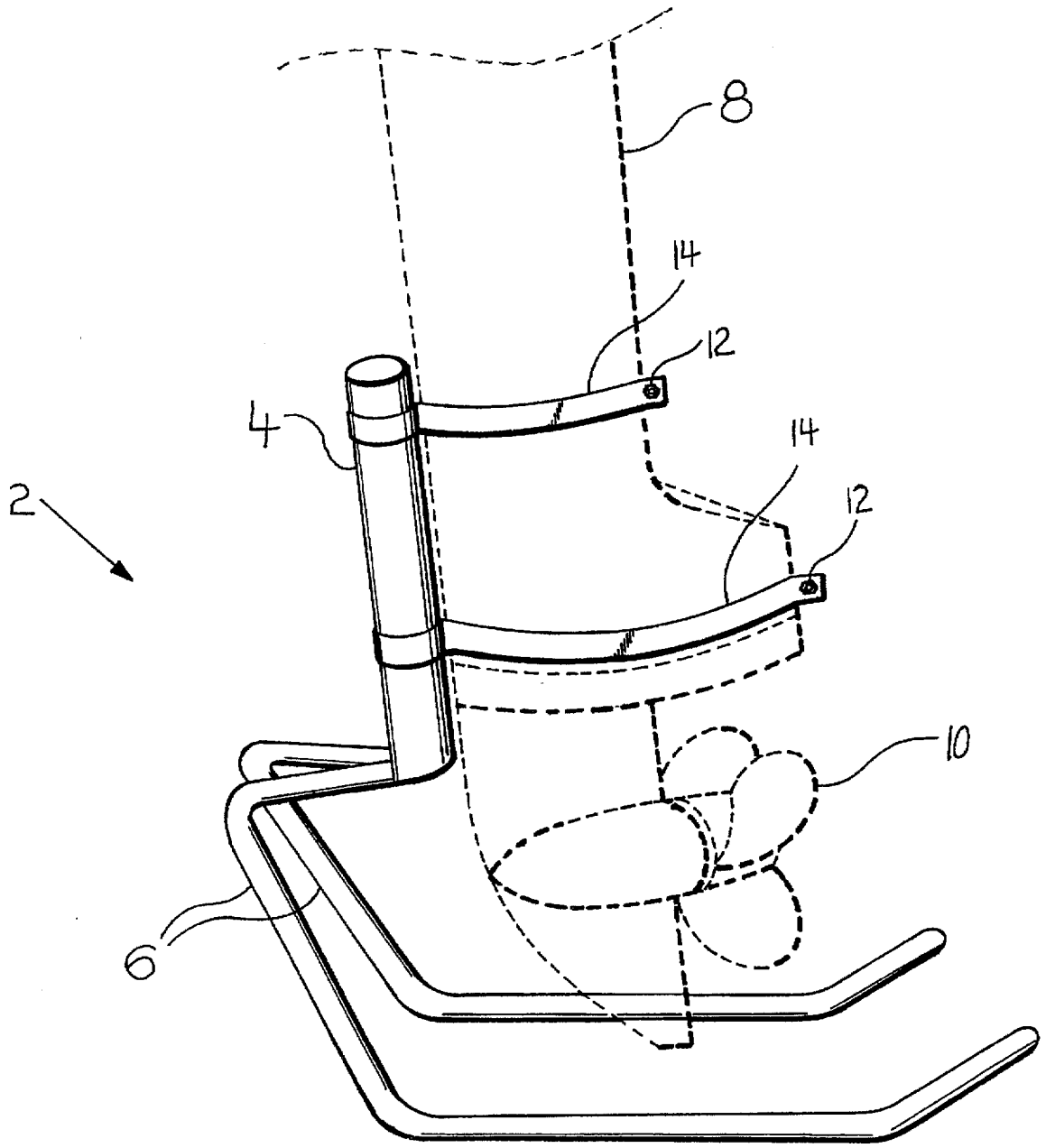
FIG. 1 is a front isometric view of a boat propeller sled mounted on a lower unit.

FIG. 1 is a front isometric view of boat propeller sled 2 mounted on lower unit 8. Boat propeller sled 2 is comprised of straps 14 and rails 6 attached to spine 4. Straps 14 are sized to frictionally admit lower unit 8, and are tightened on lower unit 8 via fasteners 12. In the preferred embodiment, fasteners 12 were corrosion-resistant nuts and bolts. Rails 6 protect propeller 10 from sand bars and other underwater obstructions, and also serve to protect swimmers and underwater animals from propeller 10.

Rails 6 are attached to a lower extreme of spine 4. Referring now to FIG. 2, which is a side isometric view of boat propeller sled 2, each rail 6 may be observed to comprise base 16, forward ramp 18, runner 20, and rear ramp 22.

As may be observed from FIG. 3, a side view of boat propeller sled 2, base 16 is attached to spine 4 at an angle of approximately ninety degrees, so that base 16 is disposed approximately parallel to the water surface. The optimum angles of attachment of the various rail 6 components were established experimentally. Forward ramp 18 is attached to an extreme of base 16 opposite spine 4, at an angle of approximately sixty degrees. Runner 20 is attached to an extreme of forward ramp 18 opposite base 16, at a forward ramp angle 24 of approximately one hundred twenty degrees, so that runner 20 is disposed approximately parallel to the water surface. Rear ramp 22 is attached to an extreme of runner 20 opposite forward ramp 18, at a rear ramp angle 26 of approximately one hundred fifty degrees.

Figure 4:
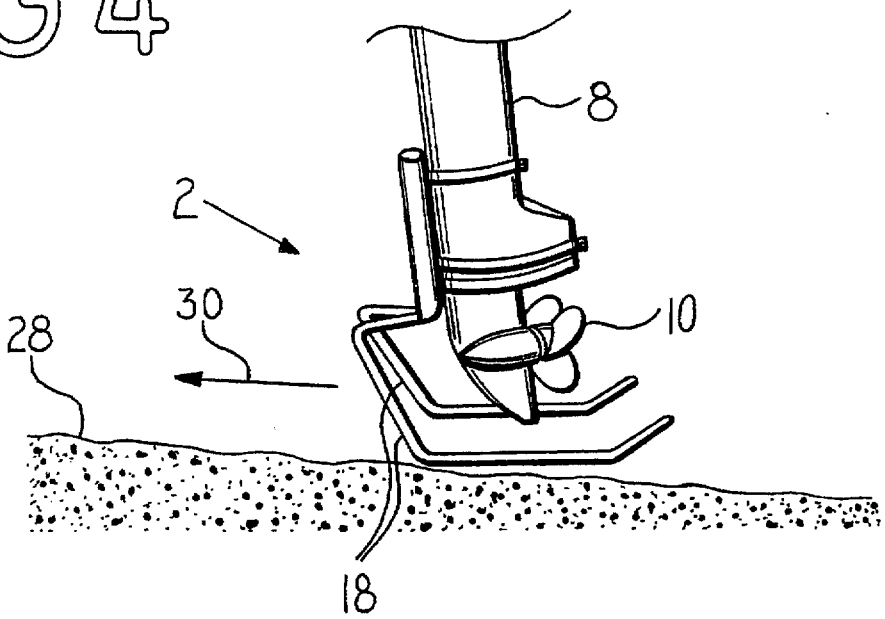
FIG. 4 is a side isometric view of a boat propeller sled attached to a lower unit in the process of ruining aground on a sand bar.

FIG. 4 is a side isometric view of boat propeller sled 2 attached to lower unit 8 in the process of running aground on sand bar 28, as indicated by forward arrow 30. As may be observed in FIG. 4, boat propeller sled 2 provides advance warning of the imminent grounding of lower unit 8. At the same time, forward ramps 18 allow boat propeller sled 2 to slide up and over sand bar 28, acting as a species of inverse "cow-catcher". All the while, boat propeller sled 2 prevents lower unit 8 from coming into contact with sand bar 28, thus protecting propeller 10 from damage.

Figure 5:
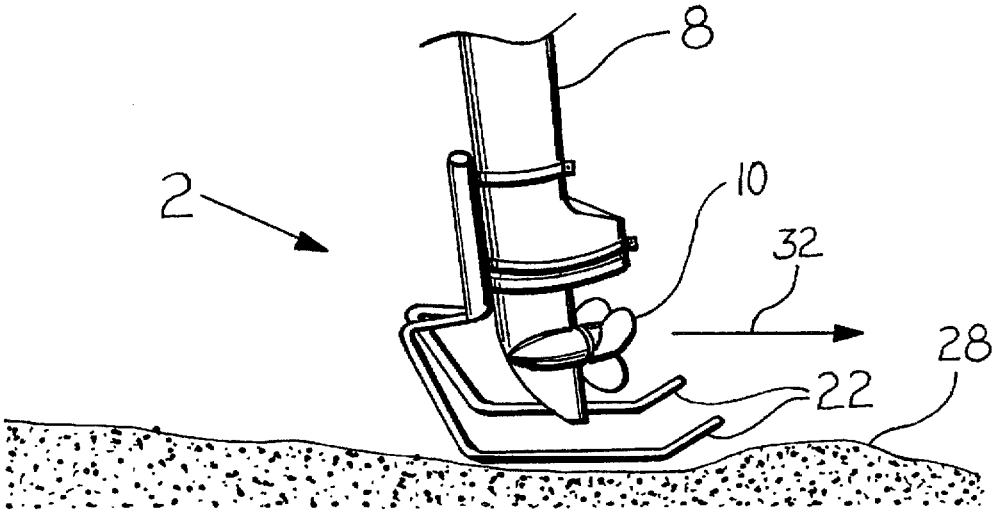
FIG. 5 is a side isometric view of a boat propeller sled attached to a lower unit in the process of backing off of a sand bar.

FIG. 5 is a side isometric view of boat propeller sled 2 attached to lower unit 8 in the process of backing off of sand bar 28. The upward slope of rear ramps 22 relative to sand bar 28 prevent the rear ends of rear ramps 22 from digging into sand bar 28. In this fashion, rear ramps 22 permit propeller 10 to pull rear unit 8 (and the boat to which it is attached) off sand bar 28, as indicated by rearward arrow 32.

In the preferred embodiment, spine 4, straps 14, and rails 6 were constructed of steel, metal, synthetic, or other appropriate material. Rails 6 were fabricated of a semi-springy metal, which afforded rails 6 some flexibility when coming into contact with underwater obstructions. In this fashion, the shock of such impacts is decreased, resulting in reduced possibility of boat and motor damage, and increased boat passenger comfort.

While a preferred embodiment of the invention has been illustrated herein, it is to be understood that changes and variations may be made by those skilled in the art without departing from the spirit of the appending claims.

DRAWING ITEM INDEX

2 boat propeller sled
4 spine
6 rail
8 lower unit
10 propeller
12 fastener
14 strap
16 base
18 forward ramp
20 runner
22 rear ramp
24 forward ramp angle
26 rear ramp angle
28 sand bar
30 forward arrow
32 rearward arrow

We claim:

1. A boat propeller sled comprising a spine, at least one strap attached to said spine, and at least one rail attached to said spine, said rail comprising a rear ramp attached to a runner at a rear ramp angle of one hundred fifty_ degrees plus or minus fifteen degrees whereby said boat propeller sled may slide backwards without said rear ramp digging into a surface over which it slides.

2. The boat propeller sled of claim 1 wherein said rail further comprises a forward ramp attached to an extreme of said runner opposite said rear ramp at a forward ramp angle, said forward ramp angle being less than one hundred eighty degrees, and greater than ninety degrees.

3. The boat propeller sled of claim 2 wherein said forward ramp angle is one hundred twenty degrees plus or minus fifteen degrees.

4. A boat propeller sled comprising:

a spine;

at least one strap attached to said spine;

at least one base attached to said spine at an angle of approximately ninety degrees; and at least one rail comprising a forward ramp attached to one extreme of a runner and a rear ramp attached to an opposite extreme of said runner, said forward ramp being attached to one said base, said forward ramp being attached to said runner at a forward ramp angle less than one hundred eighty degrees and greater than ninety degrees, said rear ramp being attached to said runner at a rear ramp angle of one hundred fifty degrees plus or minus fifteen degrees whereby said boat propeller sled may slide backwards without said rear ramp digging into a surface over which it slides.

5. A boat propeller sled comprising a spine, at least one strap attached to said spine, and at least one rail attached to said spine, said rail comprising a base attached to said spine, a forward ramp attached to an extreme of said base opposite said spine, a runner attached to an extreme of said forward ramp opposite said base, and a rear ramp attached to an extreme of said runner opposite said forward ramp at an angle of one hundred fifty degrees plus or minus fifteen degrees whereby said boat propeller sled may slide backwards without said rear ramp digging into a surface over which it slides.

6. The boat propeller sled of claim 5 wherein said forward ramp is attached to said runner at an angle of one hundred twenty degrees plus or minus fifteen degrees.

7. The boat propeller sled of claim 6 wherein said base is attached to said spine at an angle of ninety degrees plus or minus fifteen degrees.

8. The boat propeller sled of claim 5 comprising a first rail and a second rail attached to said spine, the first rail runner being substantially parallel to the second rail runner, and the first rail rear ramp being substantially parallel to the second rail rear ramp.

9. The boat propeller sled of claim 8 wherein the first rail forward ramp is substantially parallel to the second rail forward ramp.

10. A boat propeller sled comprising a spine;

two straps attached to said spine; and two rails attached to said spine, each said rail comprising a base attached to said spine, a forward ramp attached to an extreme of said base opposite said spine, a runner attached to an extreme of said forward ramp opposite said base, and a rear ramp attached to an extreme of said runner opposite said forward ramp at an angle of one hundred fifty degrees plus or minus fifteen degrees whereby said boat propeller sled may slide backwards without said rear ramp digging into a surface over which it slides.

11. The boat propeller sled of claim 10 wherein each said forward ramp is attached to one said runner at an angle of one hundred twenty degrees plus or minus fifteen degrees.

12. The boat propeller sled of claim 10 wherein each said base is attached to said spine at an angle of ninety degrees plus or minus fifteen degrees.

13. The boat propeller sled of claim 10 wherein said rear ramps are substantially mutually parallel.

14. The boat propeller sled of claim 12 wherein said forward ramps are substantially mutually parallel.

15. The boat propeller sled of claim 10 wherein said runners are substantially mutually parallel.

* * * * *

UNITED STATES PATENT AND TRADEMARK OFFICE

CERTIFICATE OF CORRECTION

PATENT NO. : 5,664,977
DATED : September 9th, 1997
INVENTOR(S) : Paul Dinkowitz and Janice O'Byrn It is certified that error appears in the above-identified patent and that said Letters Patent is hereby corrected as shown below:

| | |
|---|---|
| Column 1 line 9 | "...lime..." *should read* "...time..." |
| Column 1 line 52 | "...modem..." *should read* "...modern..." |
| Column 2 line 13 | "...wanting..." *should read* "...warning..." |
| Column 2 line 32 | "...ramps is attached..." *should read* "...ramps attached..." |
| Column 2 line 33 | "...framers..." *should read* "...runners..." |
| Column 3 line 7 | "...wilt..." *should read* "...will..." |
| Column 3 line 19 | "...ruining..." *should read* "...running..." |
| Column 4 line 39 | "...one hundred fifty _ degrees..." *should read* "...one hundred fifty degrees..." |

Signed and Sealed this

Third Day of February, 1998

*Attest:*

*Attesting Officer*

BRUCE LEHMAN

*Commissioner of Patents and Trademarks*